US008698868B2

(12) United States Patent
Hasegawa

(10) Patent No.: US 8,698,868 B2
(45) Date of Patent: Apr. 15, 2014

(54) IMAGE FORMING APPARATUS WITH PARTITION WALL BETWEEN SCANNING OPTICAL DEVICE AND PHOTOSENSITIVE DRUM

(71) Applicant: Ryo Hasegawa, Tokyo (JP)

(72) Inventor: Ryo Hasegawa, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 13/738,668

(22) Filed: Jan. 10, 2013

(65) Prior Publication Data

US 2013/0188005 A1 Jul. 25, 2013

(30) Foreign Application Priority Data

Jan. 19, 2012 (JP) ..... 2012-008572

(51) Int. Cl.
*B41J 15/14* (2006.01)
*B41J 27/00* (2006.01)

(52) U.S. Cl.
USPC ..... 347/243; 347/259

(58) Field of Classification Search
USPC ..... 347/231, 256–261, 263, 241–245
See application file for complete search history.

(56) References Cited

U.S. PATENT DOCUMENTS 5,506,719 A * 4/1996 Murakami et al. ..... 359/216.1
5,751,431 A * 5/1998 Taka et al. ..... 358/296
6,621,608 B2 * 9/2003 Iimura ..... 359/196.1

FOREIGN PATENT DOCUMENTS

JP 08-015935 1/1996
JP 2007-271835 10/2007

* cited by examiner

*Primary Examiner* — Hai C Pham
(74) *Attorney, Agent, or Firm* — Lucas & Mercanti, LLP

(57) ABSTRACT

An image forming apparatus includes a scanning optical device which performs scanning on a photosensitive drum with laser light. The scanning optical device includes a polygon motor unit, an emergence unit and a projecting unit. The polygon motor unit includes a polygon mirror which performs the scanning on the photosensitive drum with the laser light emitted from a light source. The laser light emerges from the emergence unit so that the photosensitive drum is irradiated with the laser light. The projecting unit projects to a first side where the photosensitive drum is disposed from a partition wall. The polygon motor unit is disposed in the projecting unit. The emergence unit is disposed on a second side separated from the first side by the partition wall. A gap is provided between the partition wall and the scanning optical device.

9 Claims, 11 Drawing Sheets

IMAGE FORMING APPARATUS WITH PARTITION WALL BETWEEN SCANNING OPTICAL DEVICE AND PHOTOSENSITIVE DRUM

BACKGROUND OF THE INVENTION

1. Field of the Invention

The present invention relates to an image forming apparatus.

2. Description of the Related Art

There is known an image forming apparatus which scans the circumference face of a photosensitive drum, the circumference face being charged, with laser light to form electrostatic latent images on the circumference face thereof, and develops the electrostatic latent images with a developing agent to form toner images on the circumference face thereof. It is also known that in such an image forming apparatus, a partition wall is disposed between the photosensitive drum and a scanning optical device which scans the photosensitive drum with the laser light so that the scanning optical device is prevented from being stained with toner or the like adhering to the photosensitive drum. However, in order to ensure a space to dispose the partition wall, a gap between the photosensitive drum and the scanning optical device becomes large, and accordingly a space to dispose the photosensitive drum and the scanning optical device becomes large, whereby the image forming apparatus becomes large. Then, as disclosed in Japanese Patent Application Laid-Open Publication No. hei 8-15935 or as shown in FIG. 12 of the present application, there is known an image forming apparatus in which a part of a scanning optical device projects to a side where a photosensitive drum 102 is disposed from a partition wall 103 so that a space to dispose the photosensitive drum 102 and the scanning optical device is made small.

However, as shown in FIG. 12, which shows the same case as the image forming apparatus disposed in Japanese Patent Application Laid-Open Publication No. hei 8-15935, an emergence unit 101, from which laser light emerges so that the photosensitive drum 102 is irradiated with the laser light, abuts the partition wall 103. Hence, vibration generated by operation of components of the image forming apparatus is propagated to the emergence unit 101 through the partition wall 103, and causes shifts (deviates) rays of the laser light, which emerges from the emergence unit 101. That is, accuracy of emergence of laser light from the scanning optical device is decreased, and the decrease of the accuracy of emergence of laser light results in poor image formation, such as deterioration of image quality.

BRIEF SUMMARY OF THE INVENTION

Objects of the present invention include providing an image forming apparatus which can increase accuracy of emergence of laser light from a scanning optical device.

In order to achieve at least one of the objects, according to an aspect of the present invention, there is provided an image forming apparatus including a scanning optical device which performs scanning on a photosensitive drum with laser light, the scanning optical device including: a polygon motor unit including a polygon mirror which performs the scanning on the photosensitive drum with the laser light emitted from a light source; an emergence unit from which the laser light emerges so that the photosensitive drum is irradiated with the laser light; and a projecting unit which projects to a first side where the photosensitive drum is disposed from a partition wall, wherein the polygon motor unit is disposed in the projecting unit, the emergence unit is disposed on a second side separated from the first side by the partition wall, and a gap is provided between the partition wall and the scanning optical device.

Preferably, the image forming apparatus further includes an atmospheric pressure control unit which makes atmospheric pressure in a space on the second side higher than atmospheric pressure in a space on the first side.

Preferably, the image forming apparatus further includes an elastic member which substantially seals the gap between the partition wall and the scanning optical device.

Preferably, the image forming apparatus further includes an adjustment unit which adjusts a position of the scanning optical device relative to the photosensitive drum.

BRIEF DESCRIPTION OF THE SEVERAL VIEWS OF THE DRAWING

The present invention will be fully understood by the following detailed description and accompanying drawings, which are not intended to limit the present invention, wherein.

DETAILED DESCRIPTION OF THE INVENTION

In the following, an embodiment of the present invention is described in detail. The following detailed description is not intended to limit the technical scope and the like disclosed in claims attached.

Figure 1:
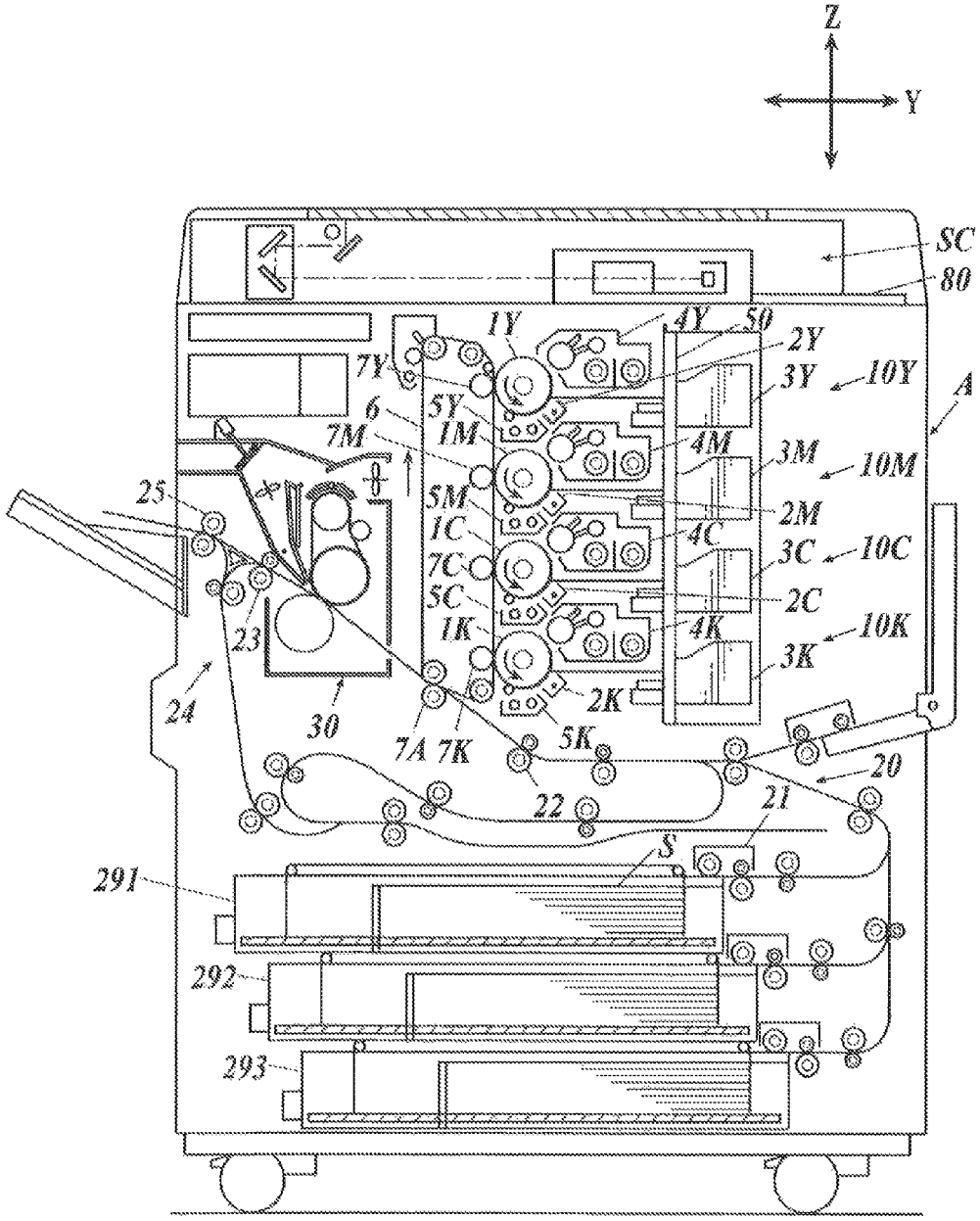
FIG. 1 shows an image forming apparatus in accordance with an embodiment of the present invention.

FIG. 1 shows an image forming apparatus A in accordance with an embodiment of the present invention.

The image forming apparatus A is called a tandem type color image forming apparatus, and performs color image formation with four image forming units.

In the following, a direction along the vertical direction is referred to as a Z direction, a direction being at right angles to the Z direction and along a sheet-shaped face of a partition wall 50 is referred to as an X direction, and a direction being at right angles to the Z direction and X direction is referred to as a Y direction.

A document placed on a document holder is exposed to light so that images thereof are scanned with the light by an optical system of a scanning exposure device of an image reading device SC. The light is read into a line image sensor, and image information signals obtained by photoelectric conversion on the light are subjected to analog processing, A/D conversion, shading correction, image compression, and the like in an image processing unit (not shown), and then inputted into a scanning optical device of each image forming unit.

The four image forming units are an image forming unit 10Y which forms yellow (Y) images, an image forming unit 10M which forms magenta (M) images, an image forming unit 10C which forms cyan (C) images, and an image forming unit 10K which forms black (K) images. The "Y", "M", "C" and "K", which are attached to their shared reference number, represent yellow, magenta, cyan and black, respectively.

The image forming unit 10Y includes a photosensitive drum 1Y, and a changer 2Y, a scanning optical device 3Y, a developing device 4Y and a drum cleaner 5Y which are disposed around the photosensitive drum 1Y.

Similarly, the image forming unit 10M includes a photosensitive drum 1M, and a changer 2M, a scanning optical device 3M, a developing device 4M and a drum cleaner 5M which are disposed around the photosensitive drum 1M. Similarly, the image forming unit 10C includes a photosensitive drum 1C, and a changer 2C, a scanning optical device 3C, a developing device 4C and a drum cleaner 5C which are disposed around the photosensitive drum 1C. Similarly, the image forming unit 10K includes a photosensitive drum 1K, and a changer 2K, a scanning optical device 3K, a developing device 4K and a drum cleaner 5K which are disposed around the photosensitive drum 1K.

The photosensitive drums 1Y, 1M, 1C and 1K of the image forming units 10Y, 10M, 10C and 10K are the same in configuration. The chargers 2M, 2K, 2C and 2K thereof are the same in configuration. The scanning optical devices 3Y, 3M, 3C and 3K thereof are the same in configuration. The developing devices 4Y, 4M, 4C and 4K thereof are the same in configuration. The drum cleaners 5Y, 5M, 5C and 5K thereof are the same in configuration. In the following, unless it is particularly necessary to make distinction, the references "Y", "M", "C" and "K" representing the colors are not attached to the shared reference numbers of these components.

The image forming units 10 write the image information signals on the photosensitive drums 1 with laser light L which emerges from the scanning optical devices 3 so as to form latent images based on the image information signals on the photosensitive drums 1. Then, the latent images are developed by the developing devices 4 so that toner images, which are visible images, are formed on the photosensitive drums 1.

Yellow (Y) toner images, magenta (M) toner images, cyan (C) toner images, and black (K) toner images are formed on the photosensitive drums 1Y, 1M, 1C and 1K of the image forming units 10Y, 10M, 10C and 10K, respectively.

An intermediate transfer belt 6 is wrapped around and held by a plurality of rollers so as to move.

The yellow, magenta, cyan and black toner images respectively formed by the image forming units 10Y, 10M, 10C and 10K are successively transferred onto the intermediate transfer belt 6, which is moving, with primary transfer units 7Y, 7M, 7C and 7K, respectively, so that color images in each of which a yellow (Y) layer, a magenta (N) layer, a cyan (C) layer and a black (K) layer are superposed on top of each other are formed on the intermediate transfer belt 6.

A paper conveyance unit 20 carries sheets S. The sheets S are housed in paper feeding trays 291, 292 and 293 so as to be fed with a paper feeding unit 21, and carried to a secondary transfer unit 7A via resist rollers 22 so that the color images on the intermediate transfer belt 6 are secondary transferred onto the sheets S. The sheets S onto which the color images are transferred are heated and pressed by a fixation device 30 so that the color images are fixed on the sheets S, and ejected outside the image forming apparatus A via fixation conveyance rollers 23 and paper ejection rollers 25.

The image forming apparatus A includes a paper reversing unit 24, and guides the sheets S on which the color images are fixed from the fixation conveyance rollers 23 to the paper reversing unit 24, so that the sheets S can be reversed to be ejected outside the image forming apparatus A, or image formation can be performed on the other face of the sheets S (duplex printing).

A size of sheets S to be subjected to image formation, the number of the sheets S and the like can be set with an operation display unit 80 disposed at the upper part of a main body of the image forming apparatus A.

Each of the scanning optical devices 3 includes a scanning optical device casing 302, a projecting unit 303 and a housing unit 304. The scanning optical device casing 302 is a casing of the scanning optical device 3. The housing unit 304 houses an emergence unit 301 from which the laser light L emerges. The projecting unit 303 projects from the partition wall 50 to a photosensitive drum 1 side (a first side) where the photosensitive drum 1 is disposed. The scanning optical device 3 performs scanning on the photosensitive drums 3 with the laser light L. The scanning optical device 3 is described below in detail.

The partition wall 50 is a sheet-shaped member disposed to separate the housing unit 304 of each scanning optical device 3 from its corresponding photosensitive drum 1. The partition wall 50 is fixed to chassis or the like which fix or maintain a positional relationship of the components (units and the like) of the image forming apparatus A. Hence, the scanning optical device 3 is disposed in which a way that the projecting unit 303 is located on the photosensitive drum 1 side, and the emergence unit 301 is located on the other side (a second side or a housing unit 304 side), with the partition wall 50 disposed between the photosensitive drum 1 side and the other side.

Gaps S1 and S2 are provided between the partition wall 50 and the scanning optical device 3.

Figure 2:
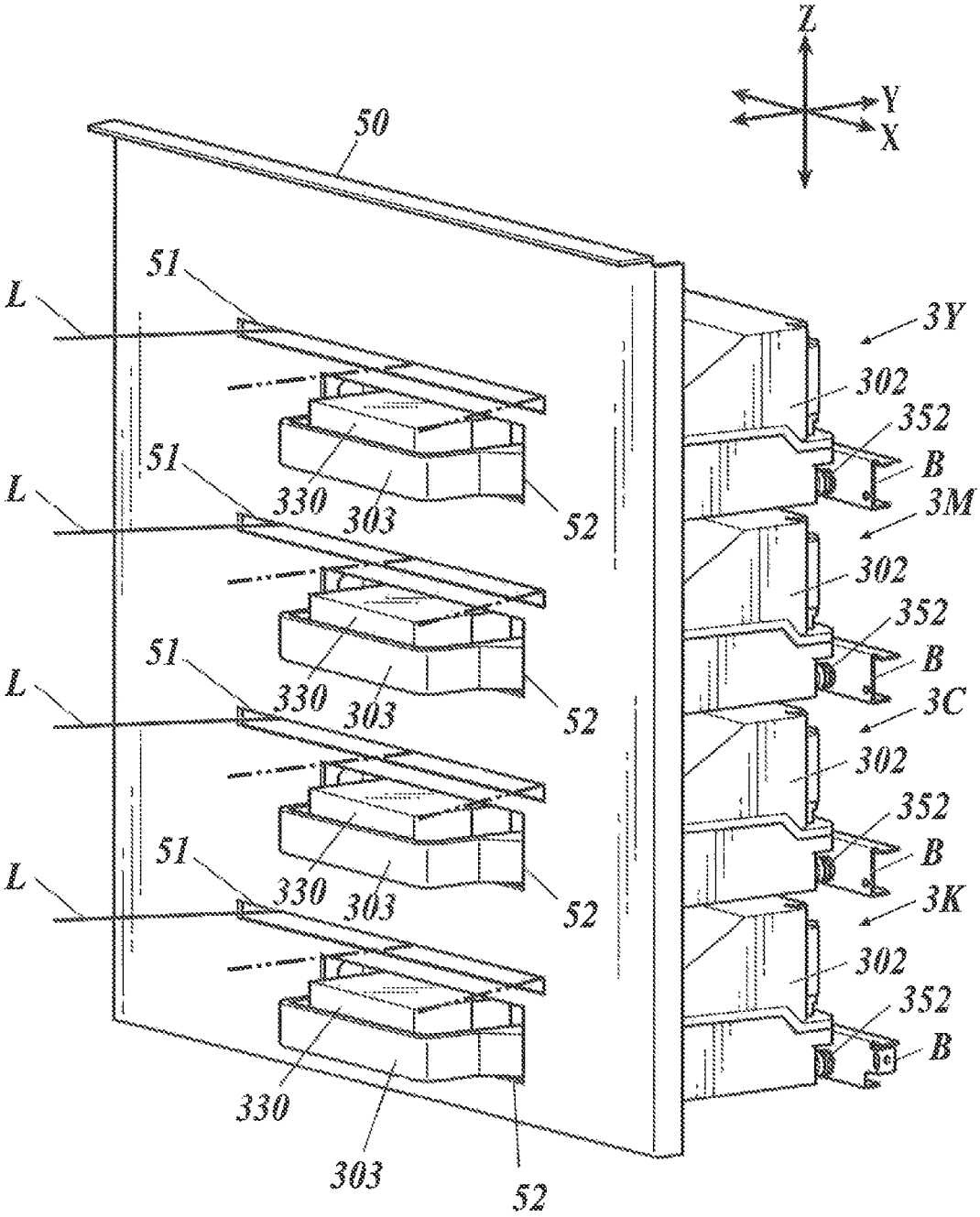
FIG. 2 is a perspective view showing configurations of scanning optical devices and a partition wall of the image forming apparatus.
Figure 3:
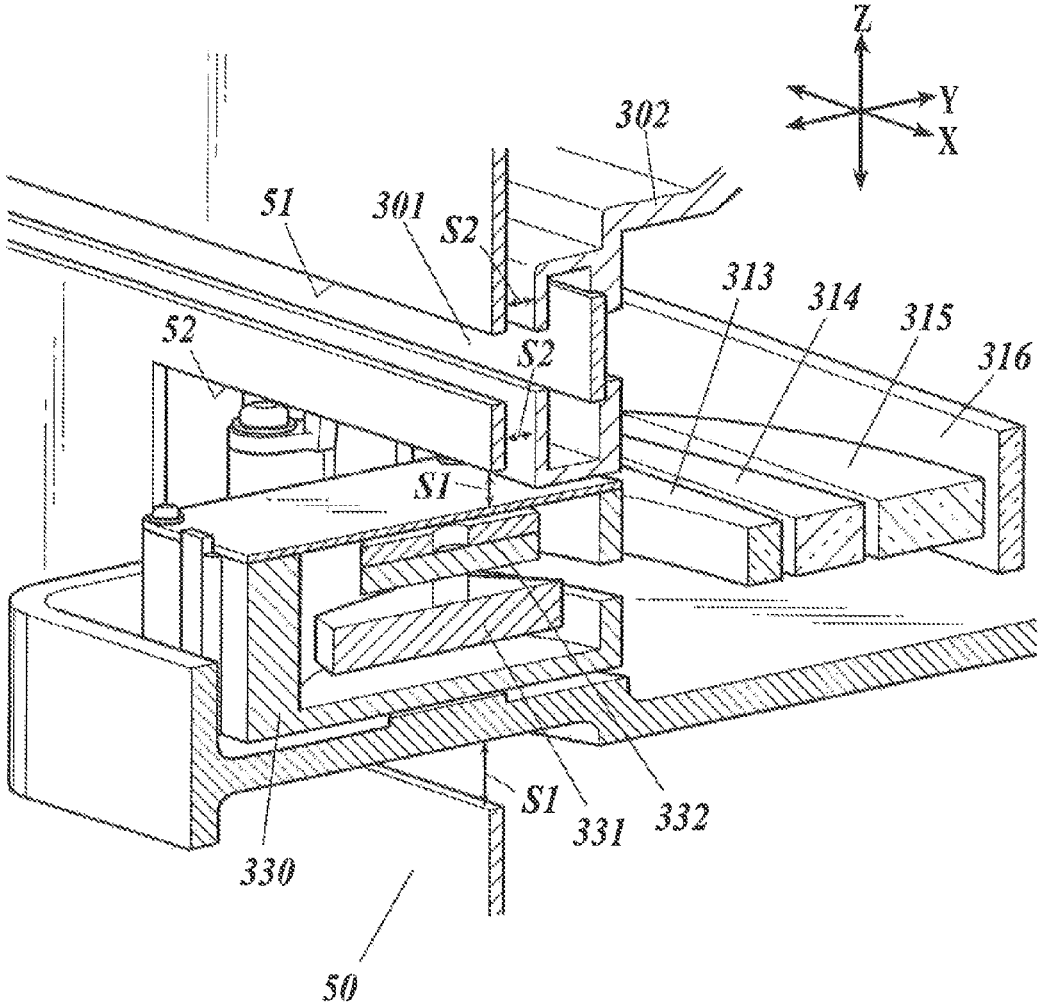
FIG. 3 is a perspective view of a Y-Z plane section of a projecting unit and its vicinity, the projecting unit being included in each scanning optical device.
Figure 4:
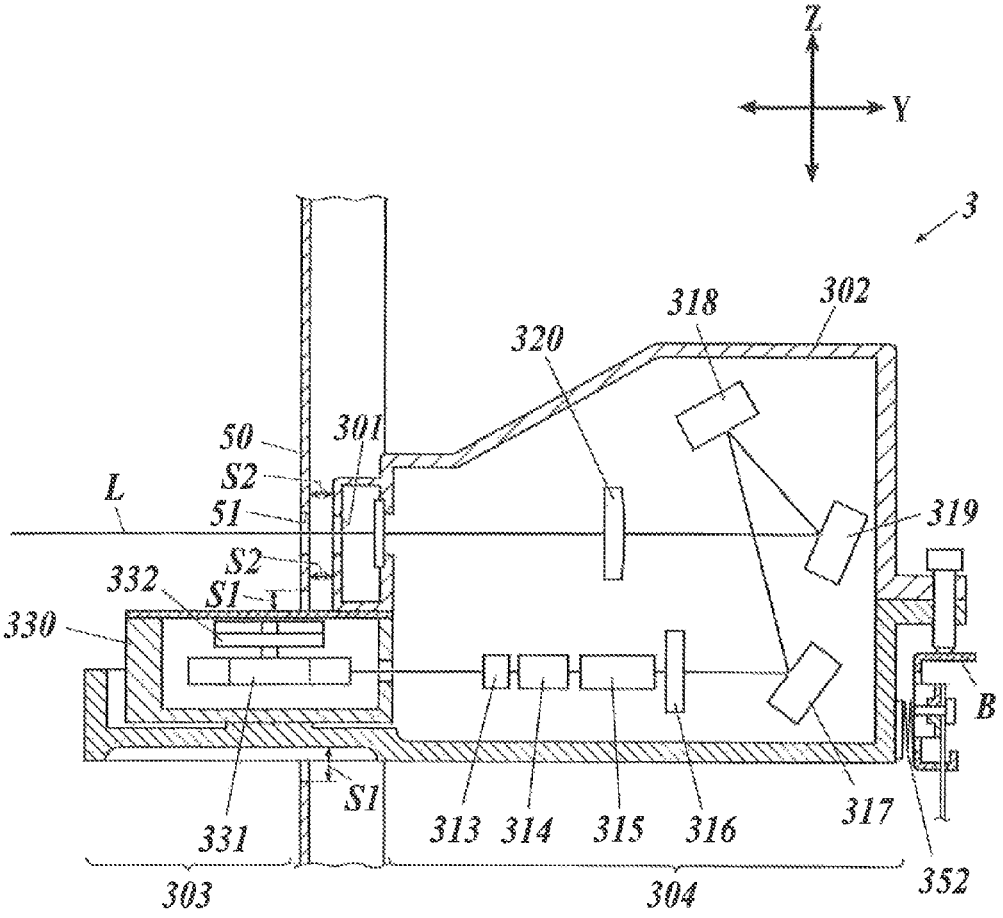
FIG. 4 is a cross-sectional view of the scanning optical device and the partition wall taken along the Y-Z plane.

More specifically, as shown in FIGS. 2 to 4, the partition wall 50 has a first opening part 52 for each scanning optical device 3. The first opening part 52 allows its corresponding projecting unit 303 of the scanning optical device 3 to be inserted into the partition wall 50. With the first opening part 52, the projecting unit 303 and the partition wall 50 are noncontact, and the gap S1 exists between the projecting unit 303 and the partition wall 50.

The partition wall 50 also has a second opening part 51 for each scanning optical device 3. The second opening part 51 allows the laser light L, which emerges from the emergence unit 301 to be directed to its corresponding photosensitive drum 1 so that the photosensitive drum 1 is irradiated with the laser light L, to pass through the partition wall 50. The emergence unit 301 is disposed in such a way as to face the second opening part 51. The emergence unit 301 and the partition wall 50 are noncontact, and the gap S2 exists between the emergence unit 301 and the partition wall 50.

Figure 5:
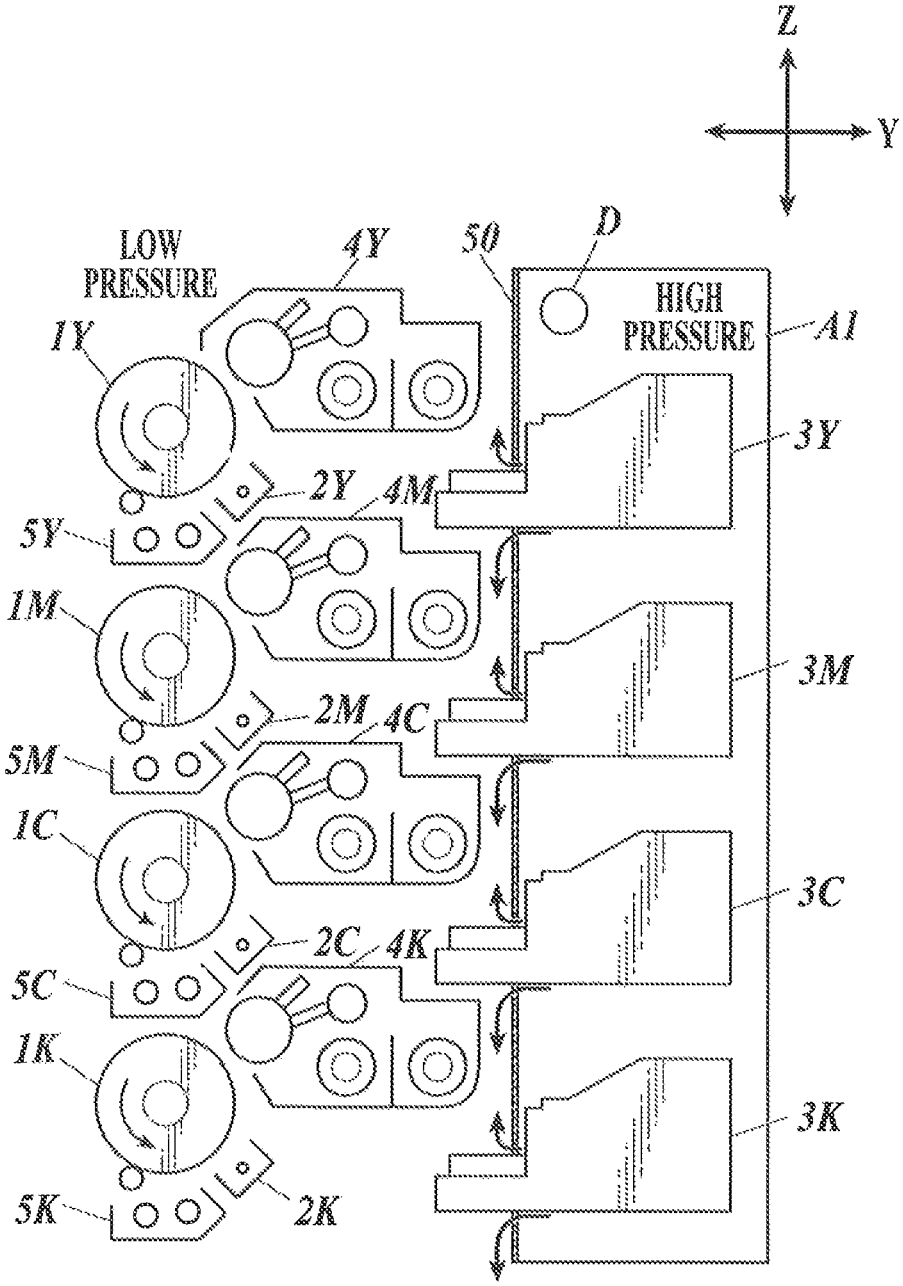
FIG. 5 is a schematic view showing atmospheric pressure difference between spaces next to each other, the spaces sandwiching the partition wall.

As shown in FIG. 5, the image forming apparatus A is configured in such a way that the atmospheric pressure in a space A1 on the housing unit 304 side where the housing unit 304 of the scanning optical device 3 is disposed is higher than the atmospheric pressure in a space on the photosensitive drum 1 side, with the partition wall 50 disposed between the housing unit 304 and the photosensitive drum 1 side.

More specifically, the image forming apparatus A has a fan F or the like to send the air from outside into the space A1 on the housing unit 304 side as a component to increase the atmospheric pressure in the space A1. The air supplied from outside by the fan F is, for example, sent into the space A1 through an air path, such as a duct D shown in FIG. 5, and flows into the photosensitive drum 1 side through the gaps (S1 and S2) between each scanning optical device 3 and the partition wall 50. That is, the air flows from the housing unit 304 side to the photosensitive drum 1 side through the partition wall 50.

Each scanning optical device 3 includes an adjustment unit 350 which adjusts the position of the scanning optical device 3 relative to its corresponding photosensitive drum 1, namely, adjusts the distance from the scanning optical device 3 to the photosensitive drum 1.

More specifically, the adjustment unit 350 includes a cam 351, a coil spring 352, a first gear 353 and a second gear 354. The cam 351 abuts one end part of the scanning optical device 3 in the Y direction on the photosensitive drum 1 side, and has teeth 3512*a* formed on the outer circumferential face of a cam main body 3512. One end of the coil spring 352 is fixed to the other end part of the scanning optical device 3 in the Y direction on the housing unit 304 side. The teeth 3512*a* are engaged with teeth of the first gear 353. The first gear 353 is engaged with the second gear 354. The scanning optical device 3 is sandwiched between the cam 351 and the coil spring 352 so as to be held thereby.

The other end of the coil spring 352 is fixed to a chassis B in a casing of the image forming apparatus A.

Figure 6:
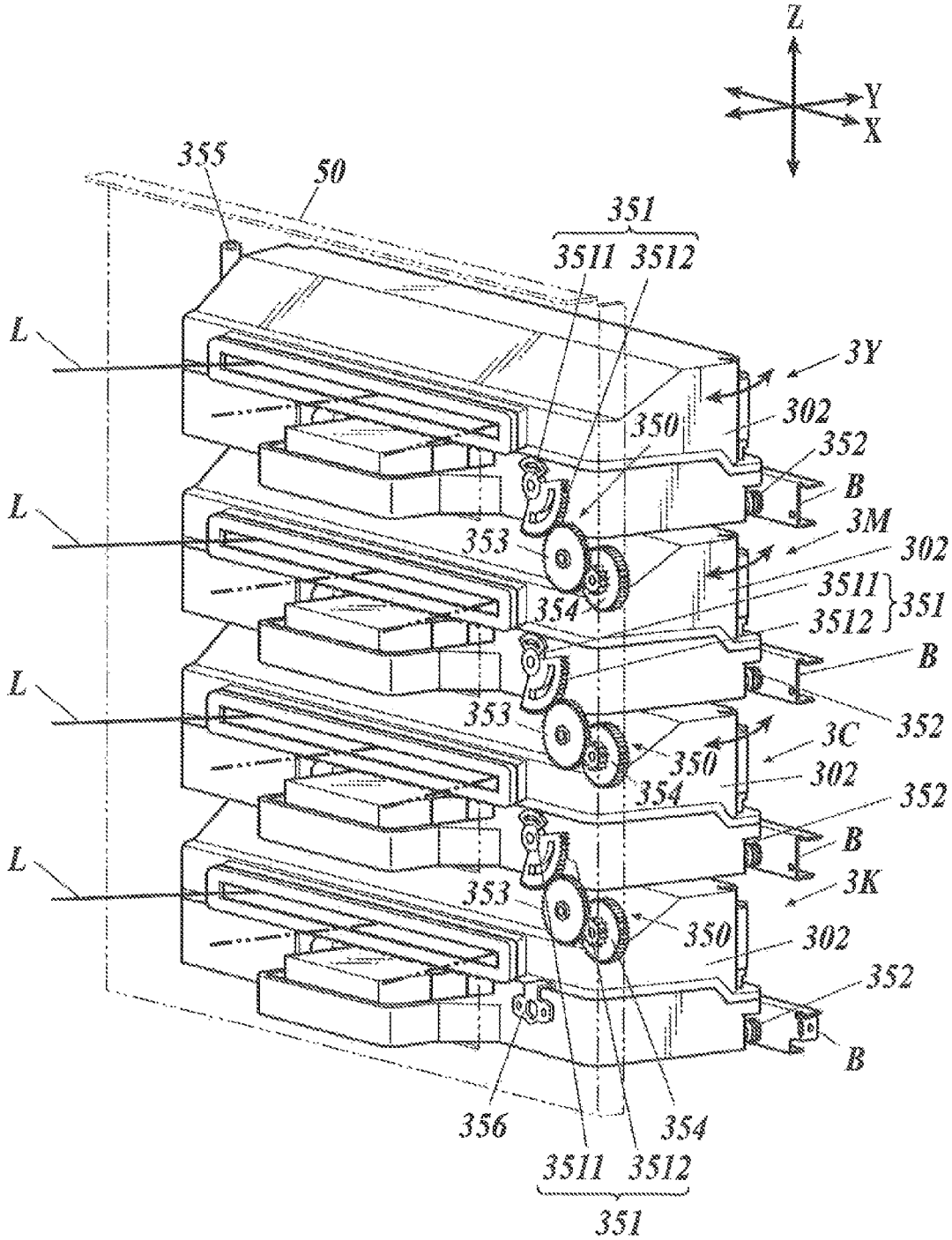
FIG. 6 shows position adjustment mechanism (adjustment units) of the scanning optical devices.

As shown in FIG. 6, the cam 351 includes a shaft bearing unit 3511 and the cam main body 3512. The shaft bearing unit 3511 can rotate, as its center, on a rotating shaft along the X-Z plane. The rotating shaft is disposed in the scanning optical device 3 along the Y direction. The cam main body 3512 is in the shape of a fan taking the shaft bearing unit 3511 as its center. On the arc-shaped outer circumferential face of the cam main body 3512, the teeth 3512*a* are disposed.

The cam main body 3512 includes a fan-shaped flat face 3512*b* and a fan-shaped inclined face 3512*c* which inclines in the Z direction.

Figure 7:
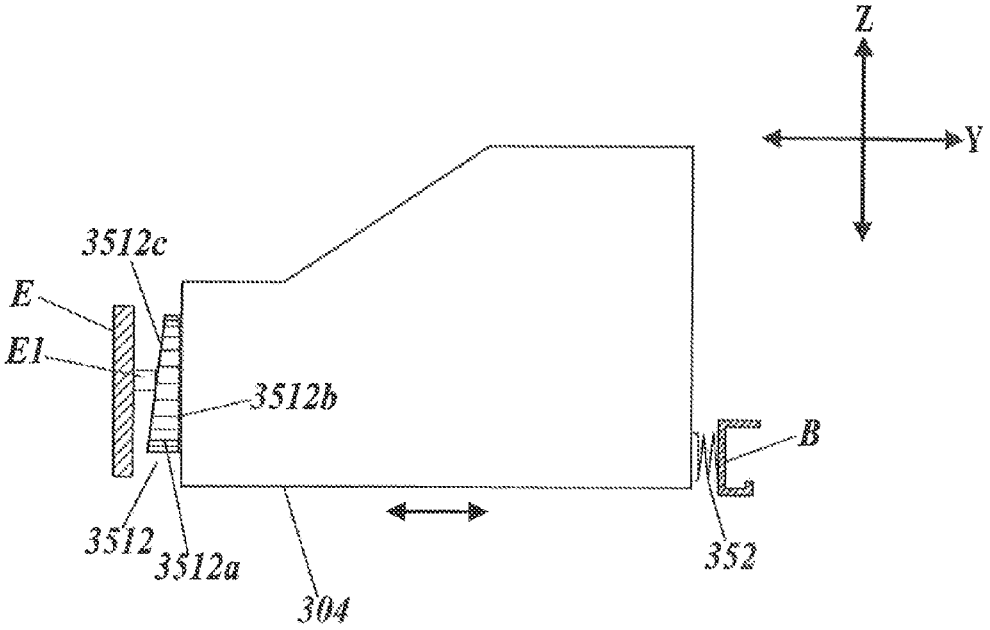
FIG. 7 is a schematic view showing the position adjustment mechanism along the Y-Z plane.

That is, as shown in FIG. 7, the cam main body 3512 is configured in such a way that the thickness in the Y direction thereof continuously changes from one side to the other side in the fan shape.

As shown in FIG. 7, the flat face 3512*b* abuts the housing unit 304 of the scanning optical device 3, and the inclined face 3512*c* abuts a projection E1 of an extended unit E. The extended unit E extends from the casing of the image forming apparatus A in such a way as to be thrust into between the partition wall 50 and the scanning optical device 3. The projection E1 is configured to abut the inclined face 3512*c* at a point, for example.

Consequently, the distance between the projection E1 and the scanning optical device 3 continuously changes as the rotation angle of the cam 351 changes.

In FIG. 6, in order to clearly show the position of each adjustment unit 350, namely, a positional relationship between the components of the adjustment unit 350, the extended unit E is not shown.

The adjustment unit 350 is disposed on one end part of the scanning optical device 3 in the X direction. As shown in FIG. 6, the scanning optical device 3 is configured in such a way as to rotate on, as its center, a rotating shaft 355 along the X-Y plane. The rotating shaft 355 is disposed on the other end part of the scanning optical device 3 in the X direction. The scanning optical device 3 rotates on the rotating shaft 355 according to the change of the thickness of the cam main body 3512 disposed between the projection E1 and the scanning optical device 3. As the scanning optical device rotates on the rotating shaft 355, the position of the scanning optical device 3 relative to the photosensitive drum 1 changes.

The second gear 354 can be manually rotated by an operator when the image forming apparatus A is served. The rotation angles of the cam 351, the first gear 353 and the second gear 354 are maintained, namely, not to be changed, except for the time when the second gear 354 is manually rotated by an operator. The rotation angles are maintained by friction generated by the shaft bearing unit 3511 of the cam 351, a rotating shaft of the first gear 353, a shaft bearing unit of the first gear 353, a rotating shaft of the second gear 354 and/or a shaft bearing unit of the second gear 354. An operator can adjust the position of the scanning optical device 3 relative to the photosensitive drum 1 by manually rotating the second gear 354 so as to change the rotation angle of the cam 351.

In the embodiment, as shown in FIG. 6, the scanning optical devices 3Y, 3M and 3C are disposed in such a way that the positions thereof can be adjusted by their respective adjustment units 350, and the scanning optical device 3K is fixed to the image forming apparatus A by being sandwiched between a fixing tool 356 and the coil spring 352 to as to be held thereby. An operator adjusts the positions of the scanning optical devices 3Y, 3M and 3C so as to adjust the angles of emergence of the laser light L along the X-Y plane, the laser light L emerging from the scanning optical devices 3Y, 3M and 3C, taking a black (K) toner image formed by the laser light L emerging from the scanning optical device 3K as a reference so that the black (K) toner image, a yellow (Y) toner image, a magenta (N) toner image and a cyan (C) toner image are appropriately superposed on top of each other to form a color image.

The accuracy of superposition of toner images by position adjustment of the scanning optical devices 3Y, 3M and 3C is visually confirmed by an operator after an image (a color image) is formed and outputted on a sheet S. However, this is just an example. Hence, how to confirm the accuracy thereof is not limited thereto. For example, it is possible that a detection unit which detects the angles of emergence of the laser light L emerging from the scanning optical devices 3Y, 3M, 3C and 3K is provided, and the accuracy of superposition of toner images is confirmed by the detection result of the detection unit. In this case, the positions of the scanning optical devices 3Y, 3M and 3C may be automatically adjusted by operating position adjustment motors connected to their respective second gears 354 depending on the angles of emergence of the laser light L detected by the detection unit.

Furthermore, in the embodiment, the scanning optical device 3K is fixed to the image forming apparatus A so that the position thereof cannot be adjusted. However, instead of the scanning optical device 3K, the scanning optical device 3Y, 3M or 3C may be fixed to the image forming apparatus A so that the position thereof cannot be adjusted. Alternatively, all the scanning optical devices 3 may be configured in such a way that the positions thereof relative to their respective photosensitive drums 1 can be adjusted.

Figure 8:
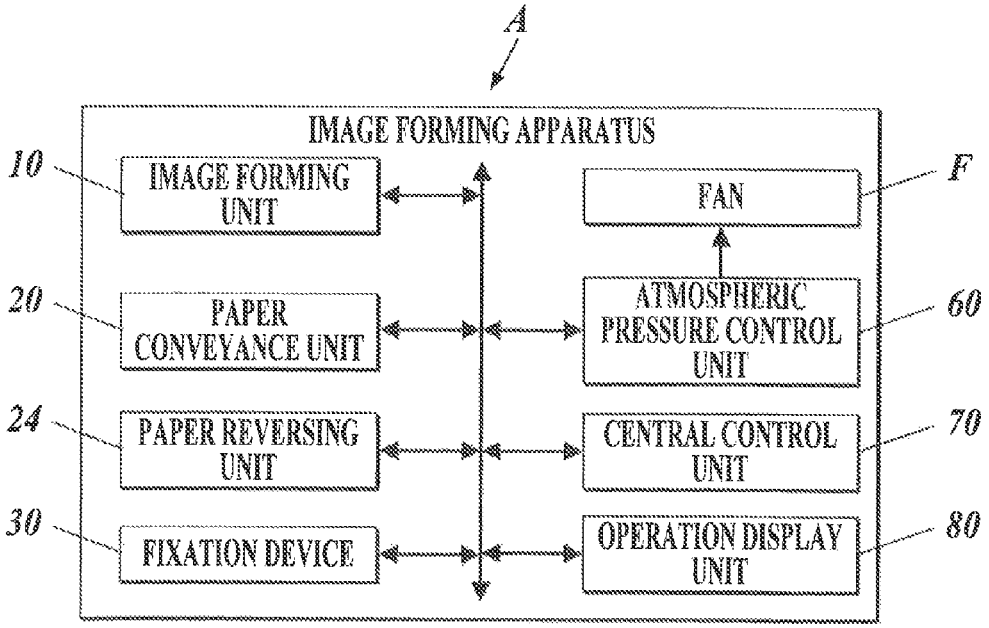
FIG. 8 is a block diagram of the image forming apparatus.
Figure 9:
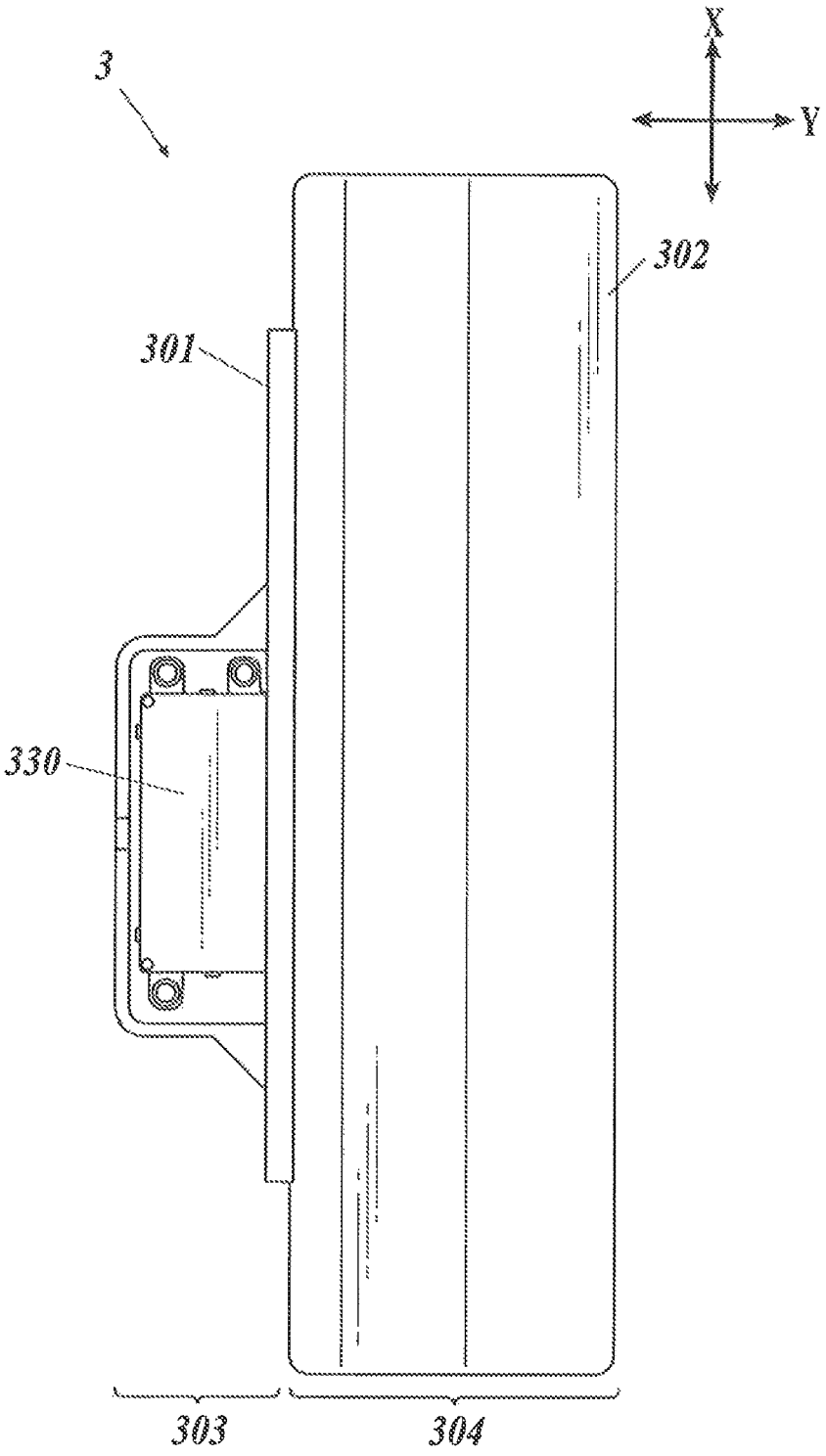
FIG. 9 shows an external shape of the scanning optical device viewed from above the image forming apparatus shown in FIG. 1.
Figure 10:
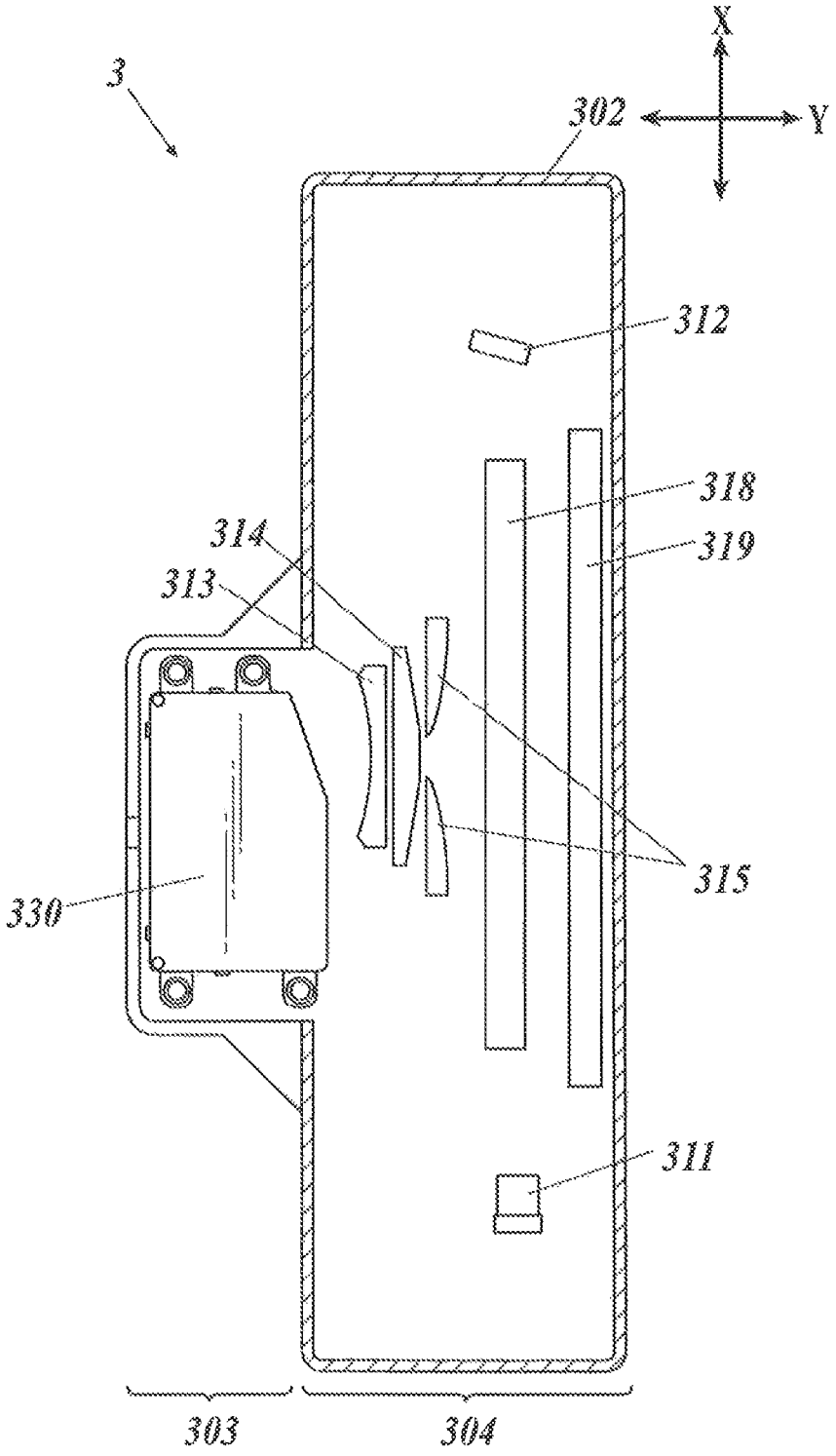
FIG. 10 shows an internal configuration of the scanning optical device shown in FIG. 9.

FIG. 8 is a block diagram of the image forming apparatus A.

The image forming apparatus A includes an atmospheric pressure control unit 60 and a central control unit 70 in addition to the components described above.

The atmospheric pressure control unit 60 controls operation of the fan F so as to make the atmospheric pressure in the space A1 on the housing unit 304 side higher than the atmospheric pressure in the space on the photosensitive drum 1 side.

The atmospheric pressure control unit 60 is an electronic circuit having a function to control operation of the fan F for atmospheric pressure control, such as FPGA (Field-Programmable Gate Array). However, this is not a limitation but an example, Hence, for example, the atmospheric pressure control unit 60 may control operation of the fan F by software processing of a computer which includes a CPU, a RAM and a ROM.

The central control unit 70 is a computer which includes a CPU, a RAM and a ROM, and controls operation of the components of the image forming apparatus A by the CPU reading software corresponding to a processing content from a storage device such as the ROM, and executing the read software.

Next, the scanning optical device 3 is described in detail.

The scanning optical device 3 includes a light source 311, a polygon motor unit 330, a mirror 312, a plurality of lenses 313, 314, 315, 316 and 320, and a plurality of mirrors 317, 318 and 319. The light source 311 emits the laser light L. The mirror 312 reflects the laser light L emitted from the light source 311 so as to guide the laser light L to the polygon motor unit 330. The lenses 313, 314, 315, 316 and 320, and the mirrors 317, 318 and 319 are disposed, as the optical system of the scanning optical device 3, on a path of the laser light L from the polygon motor unit 330 to the emergence unit 301 so as to change the travelling direction of the laser light L, and guide the laser light L to the emergence unit 301.

The polygon motor unit 330 includes a polygon mirror 331 which performs scanning on the photosensitive drum 1 with the laser light L emitted from the light source 311, and a polygon motor 332 which rotates the polygon mirror 331.

The polygon mirror 331 is a polygonal member which rotates on, as its center, a rotating shaft of the polygon motor 332. The outer circumferential face of the polygon mirror 331, the outer circumferential face corresponding to the sides of the polygonal shape, constitutes the mirror which reflects the laser light L. The polygon motor 332 operates the polygon mirror 331 so that the polygon mirror 331 changes the angle of the laser light L, which is guided to the polygon motor unit 330. More specifically, the polygon motor 332 operates the polygon mirror 331 so that the rotation angle of the polygon mirror 331 becomes an angle to form an electrostatic latent image on the photosensitive drum 1, the electrostatic latent image corresponding to image information (image forming signals) generated by the image forming apparatus A. The polygon mirror 311, the rotation angle of which changes by the polygon motor 332 operating the polygon mirror 311, changes the reflection angle of the laser light L, which is guided to the polygon motor unit 330, depending on the rotation angle. The reflection angle of the laser light L, the reflecting angle being changed depending on the rotation angle of the polygon mirror 331, is an angle in a main scanning direction which is along a shaft direction of the photosensitive drum 1.

The laser light L reflected by the polygon mirror 331 is refracted by the lenses 313 to 316 and 320, and reflected by the mirrors 317 to 319 so as to be guided to the emergence unit 301. Then, the laser light L emerges from the emergence unit 301 so that the photosensitive drum 1 is irradiated with the laser light L. That is, the angle of the laser light L, which emerges from the emergence unit 301 so that the photosensitive drum 1 is irradiated with the laser light L, in the main scanning direction, which is along the shaft direction of the photosensitive drum 1, depends on the rotation angle of the polygon mirror 331.

The scanning optical device 3 and the developing device 4 are disposed in such a way as to have a positional relationship with which the projecting unit 303 and the developing device 4 do not interfere with each other.

The polygon motor unit 330 in the embodiment is included in the projecting unit 303. That is, the projecting unit 303 houses the polygon mirror 331 and the polygon motor 332. The polygon mirror 331 reflects the laser light L which emerges from the emergence unit 301. The polygon motor 332 operates the polygon mirror 331 to rotate.

The polygon motor 332 generates heat by operating. However, the projecting unit 303, which includes the polygon motor unit 330, projects to the photosensitive drum 1 side from the partition wall 50. Consequently, the polygon motor 332, which is a heat source, is isolated so that influence of the heat onto, for example, the lenses 313, 314, 315, 316 and 320 and the mirrors 312, 317, 318 and 319 all of which are disposed on the housing unit 304 side so as to be separated from the photosensitive drum 1 by the partition wall 50, can be reduced. Furthermore, the polygon motor 332, which is a heat source, is disposed in the projecting unit 303, which projects from the partition wall 50 to the photosensitive drum 1 side. Accordingly, the polygon motor 332 can be cooled by the air and the like surrounding the projecting unit 303.

Furthermore, the optical system which changes the travelling direction of the laser light L, namely, the lenses 313, 314, 315, 316 and 320 and the mirrors 312, 317, 318 and 319, is housed in the housing unit 304.

There is a case where the lenses 313, 314, 315, 316 and 320 and the mirrors 312, 317, 318 and 319 change the refraction angles of the laser light L, the reflection angles thereof and the like when a temperature changes. Accordingly, it is preferable that the lenses 313, 314, 315, 316 and 320 and the mirrors 312, 317, 318 and 319 are disposed to be separated from the polygon motor 332 and the like, the temperature of which changes. By disposing the lenses 313, 314, 315, 316 and 320 and the mirrors 312, 317, 318 and 319 so as to be separated from the photosensitive drum 1 by the partition wall 50, namely, disposed on the housing unit 304 side, the lenses and the mirrors can be separated from the polygon motor 332 disposed on the photosensitive drum 1 side, and hence the influence of the heat on the lenses and mirrors can be reduced. That is, the accuracy of guidance of the laser light L in the travelling direction by the lenses 313, 314, 315, 316 and 320 and the mirrors 312, 317, 118 and 319 can be increased.

As described above, according to the image forming apparatus A in the embodiment, the scanning optical device 3 includes the projecting unit 303 which projects to the photosensitive drum 1 side from the partition wall 50, and houses a part of the scanning optical device 3. Accordingly, a space where the photosensitive drum 1 and the scanning optical device 3 are disposed can be made small, so that the image forming apparatus A can be miniaturized, for example. Furthermore, in the image forming apparatus A, a space (gap) between the scanning optical device 3 and the photosensitive drum 1 can be made small. Accordingly, design freedom of the image forming apparatus A can be increased. For example, a large space can be allotted for another component such as a toner cartridge.

Furthermore, the emergence unit 301 of the scanning optical device 3, the emergence unit 301 from which the laser light L emerges so that the photosensitive drum 1 is irradiated with the laser light L, is disposed to be separated from the photosensitive drum 1 by the partition wall 50. That is, the partition wall 50 exists between the emergence unit 301 and the photosensitive drum 1. Accordingly, powder dust of toner or the like flying from the photosensitive drum 1 or the like can be prevented from adhering to the emergence unit 301. That is, the emergence unit 301 can be prevented from being stained with powder dust of toner or the like adhering to the emergence unit 301. Accordingly, emergence of the laser light L from the emergence unit 301 is not obstructed by stains on the emergence unit 301.

In other words, in the image forming apparatus A in which a part of the scanning optical device 3 is projected to the photosensitive drum 1 side from the partition wall 50, the scanning optical device 3 can prevent the emergence unit 301 thereof from being stained.

Furthermore, the gaps (S1 and S2) are provided between the partition wall 50 and the scanning optical device 3. Accordingly, propagation of vibration, which is generated by the polygon motor 332 disposed in the scanning optical device 3, to the partition wall 50 can be reduced, so that propagation of vibration between the scanning optical devices 3 for the respective colors, the vibration being generated by the polygon motors 332 of the scanning optical devices 3, can be suppressed. Therefore, deviation (shifting) of the laser light L which emerges from the scanning optical device 3 can be prevented, and hence the accuracy of emergence of the laser light L from the scanning optical device 3 can be increased.

Furthermore, the atmospheric pressure in the space A1 on the housing unit 304 side is higher than the atmospheric pressure in the space on the photosensitive drum 1 side. Accordingly, the air can flow from the housing unit 304 side to the photosensitive drum 1 side, with the partition wall 50 disposed between the housing unit 304 side and the photosensitive drum 1 side, so that powder dust, such as toner dust of toner images formed on the photosensitive drum 1 side, can be prevented from entering the housing unit 304 side. Therefore, the emergence unit 301 of the scanning optical device 3 can be prevented from being stained, and hence the accuracy of emergence of the laser light L from the scanning optical device 3 can be further increased.

Furthermore, the positions of the scanning optical devices 3Y, 3M and 3C relative to the photosensitive drums 1Y, 1M and 1C can be adjusted by their respective adjustment units 350. Accordingly, the angles of emergence of the laser light L which emerges from the scanning optical devices 3Y, 3M and 3C can be adjusted so that toner images are appropriately superposed on top of each other, the toner images being formed so as to correspond to the laser light L which emerges from the scanning optical devices 3, and hence the accuracy of emergence of the laser light L from the scanning optical device 3 can be further increased.

Furthermore, the projecting unit 303 houses the polygon mirror 331, which reflects the laser light L in the scanning optical device 3, and the polygon motor 332, which rotates the polygon mirror 331. Accordingly, the polygon motor 332, which is a heat source, can be separated from the components which are disposed to be separated from the photosensitive drum 1 by the partition wall 50, namely, the components which are disposed on the housing unit 304 side, and hence influence of the heat on the components disposed on the housing unit 304 side can be reduced.

Furthermore, the polygon motor 332, which is a heat source, is disposed in the projecting unit 303, which projects from the partition wall 50 to the photosensitive drum 1 side. Accordingly, the polygon motor 332 can be cooled by the air surrounding the projecting unit 303.

Furthermore, the scanning optical device 3 includes the lenses 313, 314, 315, 316 and 320 and the mirrors 317, 318 and 319 as the optical system which changes the travelling direction of the laser light L emitted from the light source 311 so as to guide the laser light L to the emergence unit 301, and the optical system is disposed to be separated from the photosensitive drum 1 by the partition wall 50. Accordingly, the optical system can be separated from the polygon motor 332, which is housed in the projecting unit 303, and influence of the heat on the optical system can be reduced. That is, the accuracy of guidance of the laser light L in the travelling direction by the optical system, which is disposed to be separated from the photosensitive drum 1 by the partition wall 50, can be further increased.

The above-described embodiment is an example in all the aspects, and not intended to limit the scope of the present invention. That is, the scone of the present invention is not limited by the detailed description above, but limited only by claims attached including equivalents thereto and modifications therefrom without departing from the claims.

For example, the image forming apparatus A may include elastic members which substantially seal the gaps (S1 and S2) between the partition wall 50 and the scanning optical devices 3.

Figure 11:
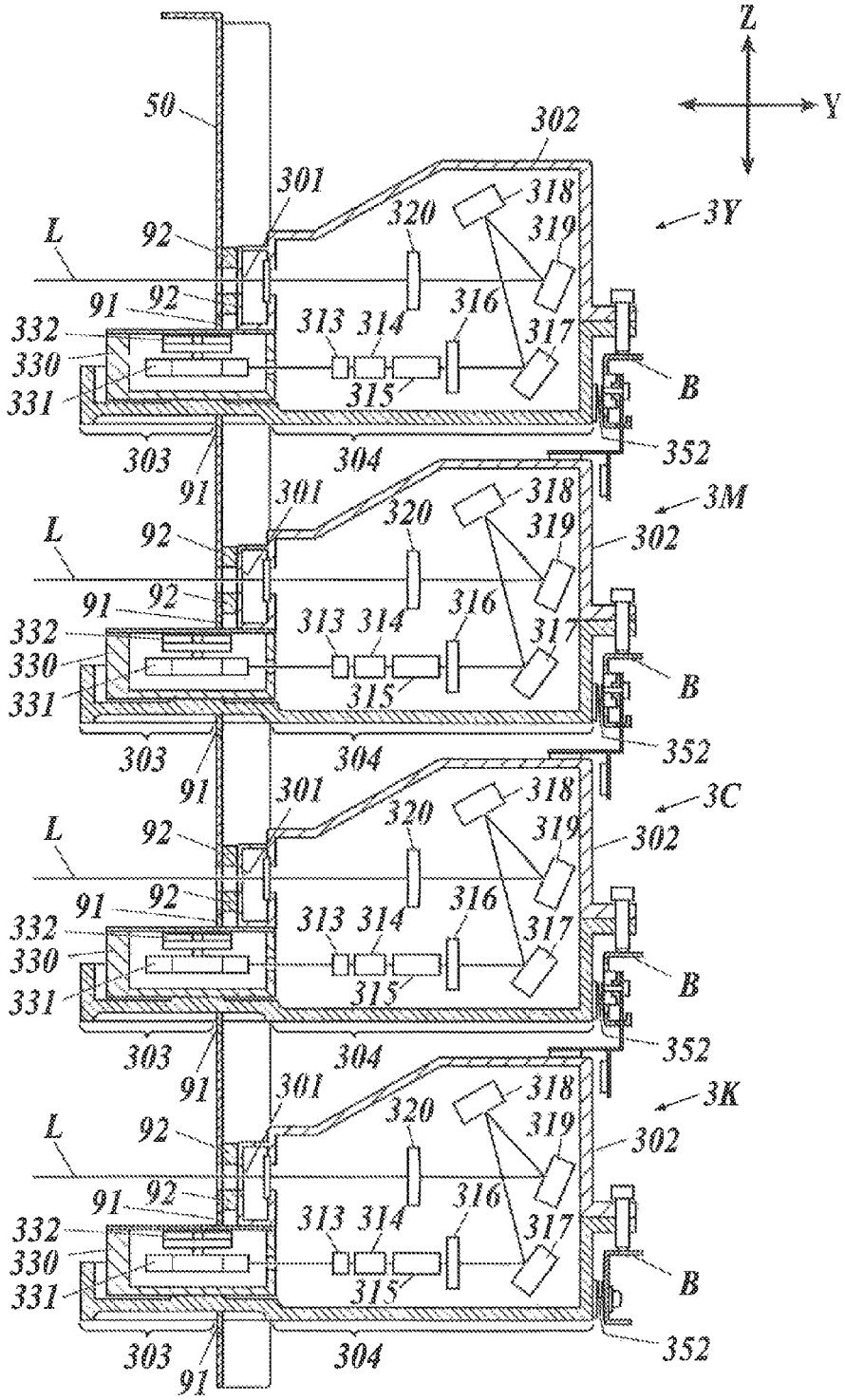
FIG. 11 is a cross-sectional view showing disposition of elastic members taken along the Y-Z plane, the elastic members substantially sealing gaps between the partition wall and each scanning optical device.
Figure 12:
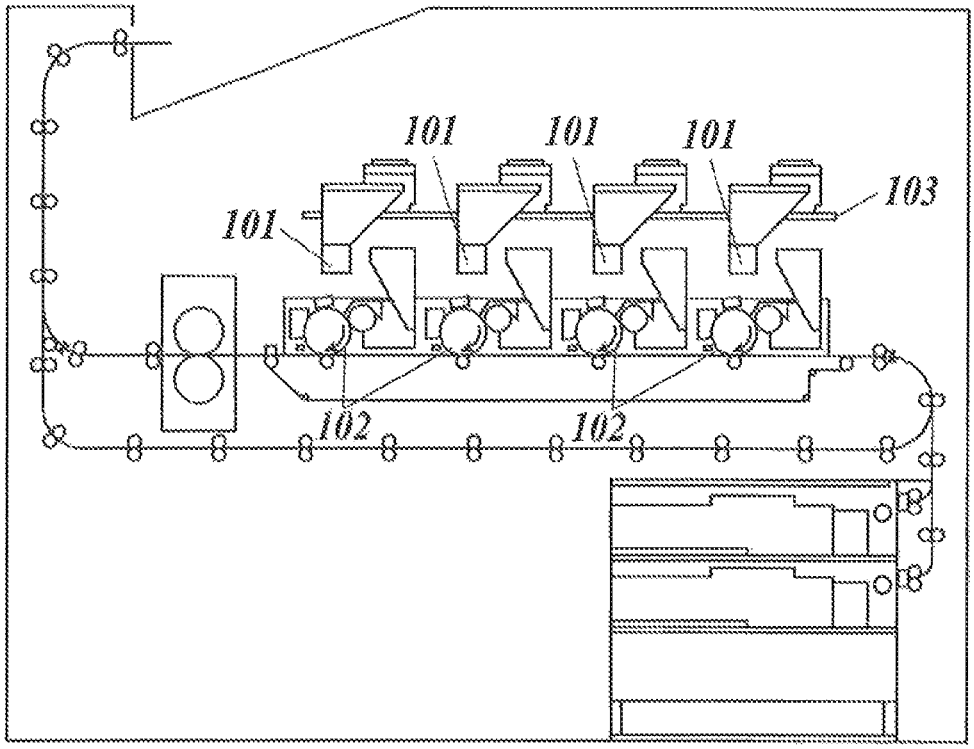
FIG.12 RELATED ART
FIG. 12 shows a configuration of a conventional image forming apparatus.

FIG. 11 is a cross-sectional view showing disposition of elastic members 91 and 92 which substantially seal the gaps between the partition wall 50 and the scanning optical devices 3.

The elastic members 91 and 92 are each made of resin such as urethane, gum or another resin material, or a combination thereof. Each elastic member 91 is a membranous elastic member which is disposed to cover the inside of the first opening part 52, and substantially seals the gap S1 between the edge of the first opening part 52 and the projecting unit 303. Each elastic member 92 is disposed to enclose the edge of the second opening part 51 on a face of the partition wall 50 on the housing unit 304 side, and substantially seals the gap S2 between the partition wall 50 and the emergence unit 301.

It is preferable that the elastic members 91 and 92 each have flexibility or elasticity to the extent that the position adjustment of the scanning optical device 3 relative to the photosensitive drum 1 is not obstructed. For example, as shown in FIG. 11, each of the elastic members 91 and 92 may have a pleated-shape, and be elastic in the Y direction, or may be elastic by physical property of its material such as resin.

The elastic members 91 and 92 substantially seal the gaps S1 and S2, respectively, between the partition wall 50 and the scanning optical device 3 so that powder dust of toner and the like on the photosensitive drum 1 side are across the partition wall 50. Accordingly, the powder dust and the like can be prevented from entering the housing unit 304 side, and hence the emergence unit 301 can be prevented from being stained with the powder dust and the like generated on the photosensitive drum 1 side.

Furthermore, in the embodiment, the image forming apparatus A includes the scanning optical devices 3 each of which includes the projecting unit 303. However, it is unnecessary to use the gap S1 between the projecting unit 303 and the first opening part 52 as a gap for the air to flow from one space to the other space separated by the partition wall 50, namely, as a gap for making the difference in the atmospheric pressure between the spaces. For example, an opening part for the air to flow may be provided at a point of the partition wall 50, the point corresponding to a point between the scanning optical devices 3 in the Z direction.

In addition, of the gaps S1 and S2 between the partition wall 50 and the scanning optical device 3 for adjusting the position of the scanning optical device 3 relative to the photosensitive drum 1, the gap S1 between the projecting unit 303 and the first opening part 52 is for the scanning optical device 3 having the projecting unit 303. Hence, the gap S1 is not provided in an image forming apparatus A if the image forming apparatus A includes a scanning optical device 3 not having a projecting unit 303.

In other words, it is unnecessary for the scanning optical device 3 to have the projecting unit 303 in terms of making a gap between the partition wall 50 and the scanning optical device 3.

Furthermore, in the embodiment, the atmospheric pressure in the space A1 on the housing unit 304 side is higher than the atmospheric pressure in the space on the photosensitive drum 1 side. However, this is not a limitation but an example. Hence, for example, an exhaust fan which communicates with the space on the photosensitive drum 1 side from outside may be provided so that the atmospheric pressure in the space on the photosensitive drum 1 side becomes lower than the atmospheric pressure in the space A1 on the housing unit 304 side.

Furthermore, the component to make the atmospheric pressure in the space A1 on the housing unit 304 side higher than that in the space on the photosensitive drum 1 side or to make the atmospheric pressure in the space on the photosensitive drum 1 side lower than that in the space A1 on the housing unit 304 side is not limited to a fan. Any device which can change the atmospheric pressure, such as a pressure pump for gas, can be used as the component.

Furthermore, in the embodiment, the cam 351 is disposed on one end part of the scanning optical device 3 in the Y direction on the photosensitive drum 1 side, and the coil spring 352 is disposed on the other end part thereof on the housing unit 304 side. However, the positions of the cam 351 and the coil spring 352 may be reversed. In this case, the other end of the coil spring 352, the one end of which is fixed to the one end part of the scanning optical device 3 in the Y direction on the photosensitive drum 1 side, may be fixed to the partition wall 50. Furthermore, the first gear 353 and the second gear 354 may be excluded.

Furthermore, the configuration of the adjustment unit 350 in the embodiment is not a limitation but an example. Hence, for example, an eccentric cam may be disposed between the extended unit 303 and the scanning optical device 3, or the rotating shaft 355 may hold the scanning optical device 3 in such a way as to change the rotation angle of the scanning optical device 3 stepwise.

Furthermore, the position of the scanning optical device 3 is not necessarily adjusted by the scanning optical device 3 rotating along the X-Y plane. For example, a guide rail or the like may be provided to adjust the position of the scanning optical device 3, the guide rail or the like which can adjust the position of the scanning optical device 3 in the Z direction, the X direction, the Y direction and/or another direction.

Furthermore, in the embodiment, the scanning optical devices 3 and the photosensitive drums 1, which are provided for the respective colors, are disposed to make a line in the vertical direction. However, this is not a limitation but an example. The disposition of the scanning optical devices 3 and the photosensitive drums 1 may be changed depending on the position of the intermediate transfer belt 6, so that the scanning optical devices 3 and the photosensitive drums 1 may be disposed to make a line in the horizontal direction, for example.

Furthermore, in the embodiment, the polygon motor unit 330 disposed in the projecting unit 303 houses the polygon mirror 331 and the polygon motor 332. However, it is possible that the projecting unit 303 houses only the polygon motor 332, and the housing unit 304 houses the polygon mirror 331. More specifically, for example, a belt member, a gear or the like may be provided as a connection unit which connects a drive shaft (a rotating shaft) of the polygon motor 332 housed in the projecting unit 303 with a rotating shaft of the polygon mirror 331 housed in the housing unit 304.

Furthermore, for example, a projection along the edge of the second opening part 51 of the partition wall 50, and projecting to the photosensitive drum 1 side may be provided, the second opening part 51 which is for the laser light L to pass through. Accordingly, the emergence unit 301 from which the laser light L emerges can be further prevented from being stained.

This application is based upon and claims the benefit of priority under 35 USC 119 of Japanese Patent Application No. 2012-008572 filed Jan. 19, 2012, the entire disclosure of which, including the description, claims, drawings, and abstract, is incorporated herein by reference in its entirety.

What is claimed is:

1. An image forming apparatus comprising:

a scanning optical device which performs scanning on a photosensitive drum with laser light;

a partition wall positioned between the photosensitive drum and the scanning optical device, the partition wall creating a first side where the photosensitive drum is disposed and a second side opposite the first side; and a gap between the partition wall and the scanning optical device, wherein the scanning optical device includes:

a polygon motor unit including a polygon mirror which performs the scanning on the photosensitive drum with the laser light emitted from a light source;

an emergence unit from which the laser light emerges so that the photosensitive drum is irradiated with the laser light; and a projecting unit which projects through the partition wall to the first side where the photosensitive drum is disposed the polygon motor unit is disposed in the projecting unit, and the emergence unit is disposed on the second side opposite the first side.

2. The image forming apparatus according to claim 1 further comprising an atmospheric pressure control unit which makes atmospheric pressure in a. space on the second side higher than atmospheric pressure in a space on the first side.

3. The image forming apparatus according to claim 1 further comprising an elastic member which substantially seals the gap between the partition wall and the scanning optical device.

4. The image forming apparatus according to claim 1 further comprising an adjustment unit which adjusts a position of the scanning optical device relative to the photosensitive drum.

5. An image forming apparatus comprising a scanning optical device which performs scanning on a photosensitive drum with laser light; the scanning optical device including:

a polygon motor unit including a polygon mirror which performs the scanning on the photosensitive drum with the laser light emitted from a light source;

an emergence unit from which the laser light emerges so that the photosensitive drum is irradiated with the laser light;

a projecting unit which projects to a first side where the photosensitive drum is disposed from a partition wall, wherein.

the polygon motor unit is disposed in the projecting unit, the emergence unit is disposed on a second side separated from the first side by the partition wall, and a gap is provided between the partition wall and the scanning optical device; and an atmospheric pressure control unit which makes atmospheric pressure in a space on the second side higher than atmospheric pressure in a space on the first side.

6. The image forming apparatus according to claim 5 further comprising an elastic member which substantially seals the gap between the partition wall and the scanning optical device.

7. The image forming apparatus according to claim 5 further comprising an adjustment unit which adjusts a position of the scanning optical device relative to the photosensitive drum

8. An image forming apparatus comprising a scanning optical device which performs scanning on a photosensitive drum with laser light, the scanning optical device including:

a polygon motor unit including a polygon mirror which performs the scanning on the photosensitive drum with the laser light emitted from a light source;

an emergence unit from which the laser light emerges so that the photosensitive drum is irradiated with the laser light;

a projecting unit which projects to a first side where the photosensitive drum is disposed. from a partition wall, wherein the polygon motor unit is disposed in the projecting unit, the emergence unit is disposed on a second side separated from the first side by the partition wall, and a gap is provided between the partition wall and the scanning optical device; and an elastic member which substantially seals the gap between the partition wall and the scanning optical device.

9. The image forming apparatus according to claim 8 further comprising an adjustment unit which adjusts a position of the scanning optical device relative to the photosensitive drum.

* * * * *